US006035581A

United States Patent [19]

McCoy

[11] Patent Number: 6,035,581

[45] Date of Patent: Mar. 14, 2000

[54] ROAD SURFACE APERTURE FRAMES AND COVERS

[75] Inventor: Archibald H. R. McCoy, Troy, Canada

[73] Assignee: Archie McCoy (Hamilton) Ltd., Troy, Canada

[21] Appl. No.: 09/149,288

[22] Filed: Sep. 9, 1998

[51] Int. Cl.[7] ..... E02D 5/74

[52] U.S. Cl. ..... 52/20; 52/19; 404/25

[58] Field of Search ..... 52/19, 20; 404/25

[56] References Cited

U.S. PATENT DOCUMENTS

| | | | |
|---|---|---|---|
| 660,731 | 10/1900 | McLam . | |
| 1,384,712 | 7/1921 | Shanley . | |
| 3,858,998 | 1/1975 | Larsson . | |
| 4,013,374 | 3/1977 | Weiler et al. . | |
| 4,015,373 | 4/1977 | Boissier . | |
| 4,123,184 | 10/1978 | Whitlock | 404/25 |
| 4,145,151 | 3/1979 | Helms . | |
| 4,364,689 | 12/1982 | Dumortier . | |
| 4,454,039 | 6/1984 | McCoy . | |
| 4,486,122 | 12/1984 | Arntyr et al. | 404/25 X |
| 4,553,874 | 11/1985 | Thomann et al. . | |
| 4,648,740 | 3/1987 | Carlson | 404/25 |
| 4,723,866 | 2/1988 | McCauley . | |
| 4,763,449 | 8/1988 | Vigneron et al. . | |
| 4,934,715 | 6/1990 | Johnson . | |
| 4,976,568 | 12/1990 | Hess . | |
| 5,056,955 | 10/1991 | Spiess et al. | 404/25 |
| 5,106,231 | 4/1992 | Thomann . | |
| 5,195,590 | 3/1993 | Kenner . | |
| 5,295,535 | 3/1994 | Boles et al. . | |
| 5,318,376 | 6/1994 | Prescott, Sr. . | |
| 5,324,135 | 6/1994 | Smith . | |
| 5,482,400 | 1/1996 | Bavington . | |
| 5,507,590 | 4/1996 | Argandona . | |
| 5,536,110 | 7/1996 | Tompkins et al. . | |
| 5,549,411 | 8/1996 | Hawkins | 52/20 X |
| 5,611,640 | 3/1997 | Bowman . | |
| 5,628,152 | 5/1997 | Bowman . | |

OTHER PUBLICATIONS

Ontario Provincial Standard Drawing OPSD–400.070, Sep. 7, 1993.

Ontario Provincial Standard Drawing OPSD–401.040, Sep. 7, 1993.

Ontario Provincial Standard Drawing OPSD–401.050, Sep. 7, 1993.

Ontario Provincial Standard Drawing OPSD–401.060, Sep. 7, 1993.

Ontario Provincial Standard Drawing OPSD–402.020, Sep. 7, 1993.

Municipality of Metropolitan Toronto, Department of Works, Drawing No. CA–90R (W.S.), Jun., 1992.

CSA Standard C83, Item M–1, 27–Inch Manhole Frame and Cover, 1970.

CSA Standard C83, Item M–2, 30–Inch Manhole Frame and Cover, 1970.

*Primary Examiner*—Carl D. Friedman
*Assistant Examiner*—Phi Dieu Tran A
*Attorney, Agent, or Firm*—Ridout & Maybee

[57] ABSTRACT

A frame and cover for road surface installations has a one-piece cast metal frame member with an aperture therein to receive a cover member which can be used for catch basins, maintenance holes, valve chamber covers and underground vaults. The frame member has a side wall which extends smoothly downwardly between the upper and lower faces of the frame member and is free from laterally outer projections. Vibrations from vehicles moving over the frame and cover are transferred downwardly to the structure on which the frame is supported rather than to the adjacent asphalt, thereby extending the service life of the asphalt surrounding the frame. The cover member preferably has at least one lug extending laterally outwardly from its outer wall, the lugs adapted to be received in corresponding recesses formed about the aperture of the frame member. The lugs and the recesses in the frame members are provided with holes to permit the frame member and cover member to be secured to one another by a mechanical fastener. The outwardly directed lugs on the cover member do not interfere with movement of personnel and equipment through the open aperture.

14 Claims, 2 Drawing Sheets

ROAD SURFACE APERTURE FRAMES AND COVERS

FIELD OF THE INVENTION

The present invention relates to frame and cover members for installation in road surfaces to provide apertures such as catch basins, maintenance holes, valve chamber covers and covers for underground vaults containing telephone equipment or the like.

BACKGROUND OF THE INVENTION

Usually, a maintenance hole or the like in a road surface consists of an underground vault or chimney that supports on its upper end a rigid frame, usually of cast iron, the upper edge of which is desirably flush with the road surface. The rigid frame is apertured and supports a cover such as a maintenance hole cover, valve chamber cover, catch basin grating, or the like. In conventional frame and cover assemblies, the side wall of the frame is provided at its lower edge with an outwardly directed flange to assist in maintaining the position of the frame in the road surface. When the frame is installed in the road surface with its upper surface approximately flush with the road surface, the flange underlies the asphalt about the perimeter of the frame.

It has been found that the road surface adjacent the perimeter of the frame is particularly prone to deterioration, cracking and fragmentation, necessitating frequent repairs. The primary reason for the rapid deterioration of the road surface in the vicinity of the frame is that, when vehicles move over the frame and cover assembly, a certain amount of vibration is transferred from the moving load of the vehicle through the frame and cover to the asphalt adjoining the frame. It has been found that vibrations from moving vehicles are largely transferred to the asphalt by the flange at the base of the frame. While new asphalt tends to be flexible and able to absorb such vibrations, older, more brittle asphalt will tend to break up, particularly under cold winter temperatures.

Conventional frame and cover assemblies are usually also provided with means by which the cover may be secured to the frame, for example to prevent children from removing the cover and falling into a sewer. For example, in one prior art device shown in Ontario Provincial Standard Drawing OPSD-401.050, the frame is provided with a series of apertured lugs extending inwardly into the opening of the frame. The cover is bolted to these lugs through holes provided inwardly of the edge of the cover. It has been found that the provision of inwardly directed lugs on the frame restricts access of personnel or equipment through the opening. To date, no completely satisfactory means has been developed for securing the cover to the frame.

SUMMARY OF THE INVENTION

The object of the present invention is to provide frame and cover members which avoid the above-noted and other disadvantages of known frame and cover members.

In the present invention, there is provided a one-piece cast metal frame member having an upper portion with a generally planar upper face. An aperture is formed in the upper portion of the frame member, the aperture being provided with support means for supporting a cover member when inserted in the aperture. A side wall integrally formed with the upper portion of the frame member extends smoothly downwardly therefrom to a lower portion having a generally planar lower face for resting on a support surface. The side wall of the frame member is substantially free from laterally outer projections between the upper and lower faces.

The frame member according to the present invention substantially avoids the above-described problems encountered with prior art frame members having outwardly directed flanges. In the arrangement provided by the present invention, vehicle vibrations transferred to the frame member are primarily directed downwardly through the frame member to the underlying support structure. Without an outwardly directed flange or other projection on its side wall, the frame member according to the present invention provides a significant reduction in the vibrational energy transferred by the frame to the surrounding asphalt, thereby substantially extending the service life of the asphalt surrounding the frame member.

The cover member according to the present invention may preferably be securely attached to the frame member to prevent unwanted access to the road surface aperture. To accomplish this object, the cover member is provided with at least one apertured lug extending laterally outwardly from its outer wall, the aperture being adapted to receive a downwardly directed bolt or the like. The lug is adapted to be received in a corresponding recess formed in the edge wall of the aperture, a hole being provided in a lower side of the recess in which the bolt or the like is received.

By providing a cover member having outwardly directed lugs, the present invention overcomes problems encountered in the prior art with frame members having lugs which extend inwardly into the aperture of the frame member. With the cover member removed from the frame member, the absence of inwardly projecting lugs on the frame member permits personnel and equipment to pass freely through the aperture.

In one aspect, the invention provides a road surface installation frame and cover comprising: a one-piece cast metal frame member comprising: an upper portion having a generally planar upper face having an aperture therein, and said upper portion including an inwardly projecting lip adjacent a lower edge of said aperture; a lower portion having a generally planar lower face for resting on a support surface; and a side wall extending between said upper and lower portions, said side wall having an outer surface that extends smoothly downwardly and is substantially free from laterally outer projection between said upper and lower faces; and a cover member adapted to be received in said aperture and supported on said lip.

In another aspect, the invention provides a road surface installation frame and cover comprising: a one-piece cast metal frame member having a generally planar upper face having an aperture therein, and including an edge wall extending downwardly from said aperture and having an inwardly projecting lip adjacent a lower edge of said edge wall; and a cast metal cover member adapted to be received in said aperture and having an outer wall adapted to nest within said edge wall an a lower edge adapted to be supported on said lip; said cover member having at least one lug extending laterally outwardly from said outer wall thereof and having a hole extending downwardly therethrough; and said frame member having at least one recess extending outwardly in said edge wall and adapted to receive and locate said lug, and said recess having a lower side having an opening therein adapted to cooperate with a mechanical fastener passed through the hole in the lug for securing said cover to said frame.

BRIEF DESCRIPTION OF THE DRAWINGS

The invention will now be more fully described. by way of example only, with reference to the accompanying drawings, in which.

DETAILED DESCRIPTION OF PREFERRED EMBODIMENT

Figure 1:
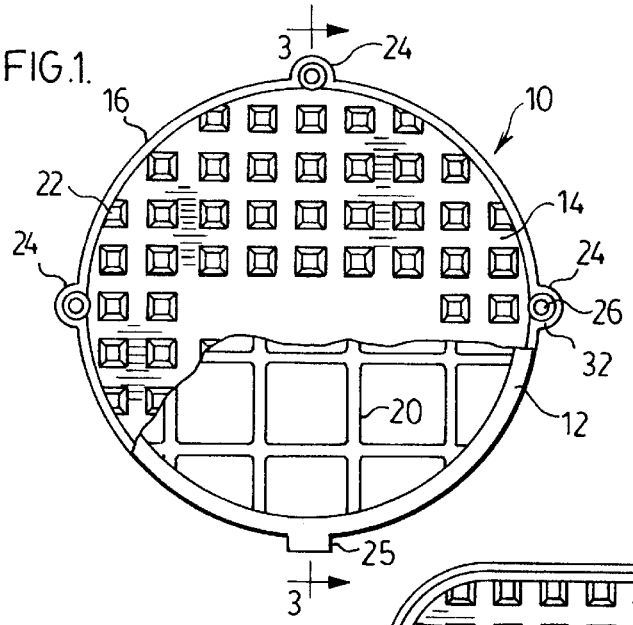
FIG. 1 shows a partially cut away plan view of an imperforate maintenance hole cover having outwardly extending lugs in accordance with the present invention.
Figure 3:
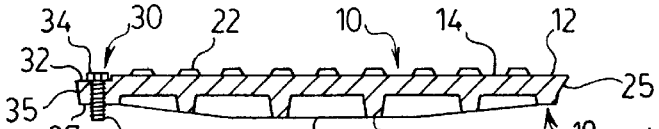
FIG. 3 shows a section along the line 3—3 in FIG. 1.

Referring to the drawings, FIG. 1 shows an imperforate, generally circular maintenance hole cover 10. Cover 10 is formed as a one-piece casting of metal, preferably iron. As best seen in FIG. 3, cover 10 has a relatively thick annular rim portion 12 and a main portion 14 of reduced thickness. Annular rim portion 12 has an outer wall 16 which tapers slightly inwardly in the downward direction and a planar, annular lower surface 18. The underside of cover 10 is strengthened by a grid of longitudinally and transversely extending ribs 20 which taper downwardly in thickness and are variable in height, the height being greatest at the center of cover 10 to provide added strength. The upper surface of cover 10 is provided with anti-slip studs 22 or other anti-slip surface discontinuities.

Cover 10 has three generally semi-circular lugs 24 extending laterally outwardly from annular rim portion 12, each lug being angularly spaced from at least one other lug by about 90 degrees. It will be appreciated that the objects of the invention may be attained by providing a cover having either more or fewer lugs 24 than shown in the drawings, so long as the cover has at least one lug 24. Each of the lugs 24 is provided with a hole 26 extending downwardly therethrough. Holes 26, which may preferably be either threaded or unthreaded, are adapted to receive the shank 28 of a bolt 30 or other mechanical fastening means. The upper surface 32 of each lug 24 is recessed at least in the vicinity of the hole 26 so that the head 34 of bolt 30 does not protrude above the upper surface of cover 10. The side surface 35 of each lug 24 preferably has an inward taper in a downward direction corresponding to the taper of the outer wall 16 of the cover 10. The lower surface 37 of each lug is preferably coplanar with the lower surface 18 of rim portion 12.

As shown in FIGS. 1 and 3, cover 10 may preferably be provided with one or more conventional locating lugs 25. Lug 25 has a generally rectangular shape when viewed in plan and, as shown in FIG. 3, slopes inwardly in a downward direction. Although lugs 24 are sufficient for the purpose of orienting the cover, as more fully discussed below, it may in some circumstances be preferred to also provide at least one locating lug 25.

Figure 2:
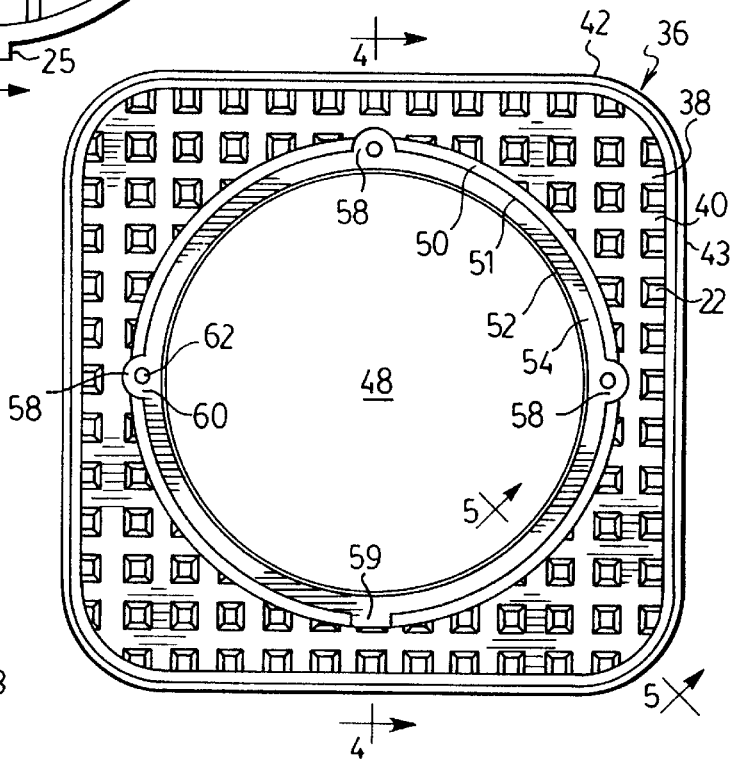
FIG. 2 shows a plan view of a frame to be used in combination with the cover of FIG. 1 and having a sidewall free from laterally outer projections in accordance with the present invention.
Figure 5:
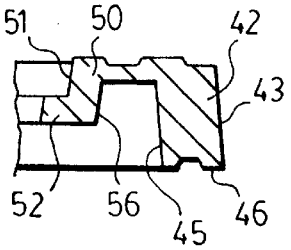
FIG. 5 shows a section along the line 5—5 in FIG. 2.
Figure 4:
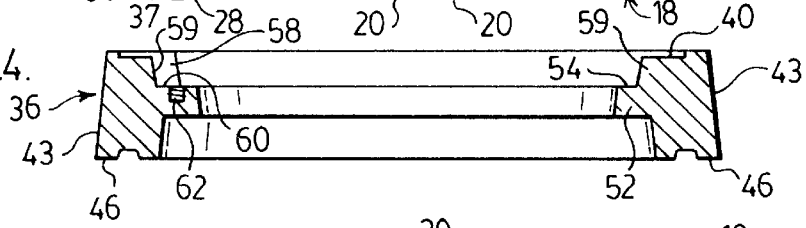
FIG. 4 shows a section along the line 4—4 in FIG. 2.

FIG. 2 shows a frame 36 which comprises a one-piece casting of iron, preferably iron. The casting is preferably generally rectangular in plan and in the preferred form is square in plan with rounded corners. Frame 36 has an upper plate portion 38 with a generally planar upper face 40 and a side wall 42 formed integrally with and depending downwardly from the peripheral edge of the plate portion 38. As shown in the sectional view of FIG. 5, side wall 42 is relatively thick and extends downwardly from the upper portion 38 to a lower portion 44 of frame 36 having a generally planar lower face 46. Side wall 42 has an outer surface 43 which is smooth and free from laterally outer projections, preferably extending in a straight line from upper face 40 to lower face 46. As shown in FIGS. 4 and 5, the outer surface 43 of side wall 42 has a slight outward taper in the downward direction.

Like cover 10, the upper surface 40 of frame 36 is provided with anti-slip studs 22 or other anti-slip discontinuities. Upper plate portion 38 is cast with a circular aperture 48 therethrough, and opening into a generally rectangular cavity. The aperture 48 is bordered by a circular edge wall 50, the inner surface 51 of which tapers slightly inwardly in the downward direction to nest with and match the taper of the outer wall 16 of the cover 10. The edge wall 50 terminates in an integrally-cast annular inwardly-extending lip 52 which provides an annular, horizontal surface 54 upon which the lower surface 18 of cover 10 is adapted to be supported.

FIG. 5 shows details of the construction of frame 36 at one of its corners. As shown, the edge wall 50 has an outer surface 56 which is parallel to the inner surface 51, and which is spaced from the inner surface 45 of side wall 42. This is to be contrasted with the construction of the frame at the midpoints of each of the four sides of frame 36, shown in FIG. 4, where the inner surface 51 of edge wall 50 and the outer surface 43 of side wall 42 are separated by a relatively small distance and therefore side wall 42 and edge wall 50 are integrally formed.

As shown in FIG. 2, generally semi-circular recesses 58 are provided extending outwardly in the edge wall 50 surrounding aperture 48. Each recess 58 is adapted to receive and locate a lug 24 of the cover 10. The recesses 58 have tapered side surfaces 59 to match the tapered side surfaces 35 of the lugs 24. Each recess 58 has a lower surface 60 on which the lower surface 37 of a lug 24 is adapted to rest. The lower surface 60 of each recess 58 is preferably coplanar with the upper surface 54 of lip 52 such that the lower surface 60 forms a planar, outward extension of the lip 52 as shown on the left side of FIG. 3. The lower surface 60 of each recess 58 is provided with a threaded hole 62 extending at least partially therethrough, hole 62 being adapted to align with hole 26 in a lug 24 and to receive the threaded shank 28 of bolt 30.

The recesses 58 are preferably located in regions of the frame 36 where the edge wall 50 of aperture 48 and the side wall 42 of frame 36 are integrally formed, for example proximate the mid-point of one or more of the sides of the frame 36. Locating the recesses at these locations is preferred in order to prevent excessive narrowing and consequent weakening of the edge wall 50 of aperture 48. Merely by way of example, it may be mentioned that the upper plate portion 38 may be about 33 inches square, side wall 42 may be about 6 inches deep, aperture 48 and rim portion 12 of cover 10 may have, a diameter of about 25 inches, and lugs 24 may have a radius of about 1 inch.

As shown in FIGS. 2 and 4, frame 36 may preferably be provided with at least one notch 59 formed in edge wall 50. Notch 50 is sized and shaped to receive a locating lug 25 and, as shown in FIG. 4, is tapered to closely receive lug 25.

Figure 6:
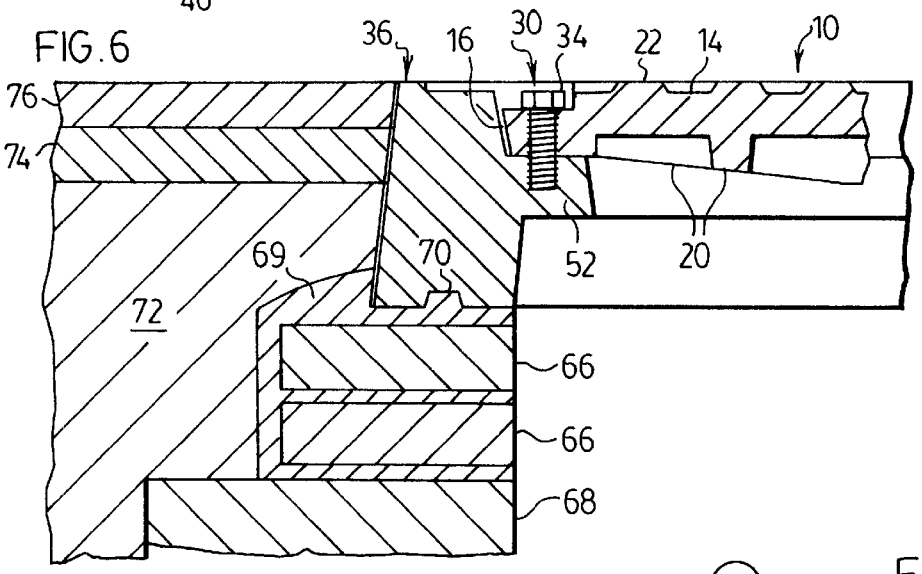
FIG. 6 shows a partial sectional view of the cover of FIG. 1 and the frame of FIG. 2 secured together and installed in a road surface.

In FIG. 6, a typical installation is shown in which the cover 10 and frame 36 are used to cover a road surface aperture such as a catch basin, maintenance hole, valve chamber or an underground vault housing telephone equipment and the like. In the example shown in FIG. 6, the frame 36 is supported by two courses of sewer bricks 66 which in turn are supported on the roof slab 68 of a sewer chamber or the like. The lower portion 44 of the frame side wall 42 is embedded in cement mortar 69 atop bricks 66, the lower face 46 being provided with an upward indentation or key 70 which forms a mechanical bond with mortar 69 thereby preventing lateral movement of the frame 36. The sewer bricks 66 and the lower portion 44 of frame 36 are preferably surrounded with a base 72 of crushed stone and/or concrete and the road surface is built up to the level of the upper face 40 of frame 36 with two courses of asphalt 74 and 76.

As discussed above, movement of vehicles over a structure such as that shown in FIG. 6 will not result in substantial premature degradation of the asphalt surrounding frame 36. Vibrations transferred to frame 36 and cover 10 by moving vehicles are directed downwardly through the side wall 42 of frame 36 to the underlying support structure, rather than outwardly to the surrounding asphalt, thereby extending the service life of the surrounding asphalt.

Figure 7:
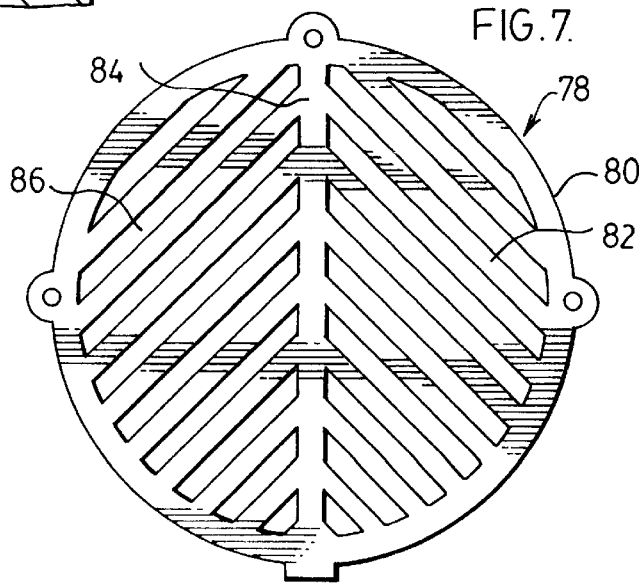
FIG. 7 shows a plan view of a catch basin cover in accordance with the present invention for use in combination with the frame of FIG. 2.

FIG. 7 illustrates a preferred cover 78 to be used in combination with frame 36 to provide a catch basin or the like. Cover 78 has an annular rim 80 surrounding a grating 82 which comprises a central bar 84 coincident with a diameter of the rim 80, and two sets of symmetrical slots 86. The two sets of slots 86 each extend from the rim 80 to the central bar 84, the slots 86 in each set being parallel to one another and inclining at the same angle from the rim 80 toward one end of the bar 84. The herringbone pattern of relatively narrow slots 42 provides a bike-proof grating, whereby the slots 86 can in use be set at an angle to the curb so that narrow bicycle wheels are not caught in the slots 86. A catch basin cover having a grating similar to that of FIG. 7 is disclosed in U.S. Pat. No. 4,454,039 to McCoy, issued Jun. 12, 1984, the teachings of which are incorporated herein by reference.

The rim 80 of cover 78 has the same external diameter and thickness as that of cover 10 shown in FIG. 1, and is provided with three lugs 88 having the same size and location as lugs 24 of maintenance hole cover 10 shown in FIG. 1, thereby allowing covers 10 and 78 to be used interchangeably with frame 36. Preferably, frame 36 and cover 78 are installed in a catch basin aperture adjacent a curb so that central bar 84 of grating 82 is perpendicular to the curb and with the direction of convergence of the two sets of slots 86 being toward the curb.

In applications where the cover must adopt a particular orientation relative to the frame, such as the catch basin disclosed above, the lugs and corresponding recesses in the frame have an important locating function. In these situations, the lugs are preferably arranged asymmetrically on the rim portion of the cover to ensure that the cover maintains a particular orientation relative to the frame. When the recesses in the frame are located proximate the mid-points of the sides of the frame and the lugs separated by an angular distance of 90 degrees as discussed above, at least one and no more than three lugs are provided on the rim portion of the cover. Although covers 10 and 78 shown in the drawings each have three lugs, it will be appreciated that the provision of only one lug, or two lugs angularly separated by 90 degrees, will also orient the cover relative to the frame.

Although the invention has been described in relation to certain preferred embodiments, it is to be understood that the invention is not restricted thereto. Rather, the invention includes all embodiments which may fall within the scope of the following claims.

What is claimed is:

1. A road surface installation frame and cover comprising:

a one-piece cast metal frame member having a generally planar upper face having an aperture therein, and including an edge wall extending downwardly from said aperture and having an inwardly projecting lip adjacent a lower edge of said edge wall; and a cast metal cover member received in said aperture and having an outer wall nesting within said edge wall and a lower edge supported on said lip;

said cover member having at least one lug extending laterally outwardly from said outer wall thereof and heaving a hole extending downwardly through said lug; and said frame member having at least one recess extending outwardly in said edge wall to receive and locate said lug, and said recess having a lower side having an opening therein to cooperate with a mechanical fastener passed through the hole in the lug to secure said cover to said frame.

2. A road surface installation frame and cover as claimed in claim 1, wherein said cover member has from two to four lugs, and each of said lugs is angularly spaced by about 90 degrees from at least one other of said lugs.

3. A road surface installation frame and cover as claimed in claim 2 wherein said cover member has three lugs.

4. A road surface installation frame and cover as claimed in claim 1 wherein said lugs and said recesses in said frame member are generally semi-circular in plan.

5. A road surface installation frame and cover as claimed in claim 1, wherein said mechanical fastener is a bolt having a head and a threaded shank.

6. A road surface installation frame and cover as claimed in claim 5, wherein said lug has an upper face which is recessed below an upper face of said cover member by an amount substantially equal to the height of the head of said bolt.

7. A road surface installation frame and cover as claimed in claim 1, wherein said frame member is generally rectangular in plan and said aperture and said cover member are circular in plan.

8. A road surface installation frame and cover as claimed in claim 1, wherein said frame and cover are adapted to cover a road surface aperture selected from the group consisting of a catch basin, maintenance hole, valve chamber and an underground vault.

9. A road surface installation frame and cover as claimed in claim 8, wherein said road surface aperture is at catch basin and said cover member comprises a catch basin grating comprising a one-piece metal casting having an annular rim, a central bar coincident with a diameter of the rim and integrally joined at each end with said rim, and the grating being symmetrical about said diameter and having two sets of slots extending from the rim to the central bar, the slots in each set being parallel and inclining at the same angle from the rim toward one end of the bar and being defined between side bar members each of which is at one end integrally joined with said annular rim and at the opposite end is integrally joined with the central bar.

10. A road surface installation frame and cover as claimed in claim 9, wherein said cover member has three of said lugs, with each of said lugs being angularly spaced by about 90 degrees from at least one other of said lugs.

11. A road surface installation frame and cover as claimed in claim 8, wherein said road surface aperture is a maintenance hole and said cover member is substantially imperforate.

12. A road surface installation frame and cover as claimed in claim 11, wherein said cover member has three of said lugs, with each of said lugs being angularly spaced by about 90 degrees from at least one other of said lugs.

13. A road surface installation frame and cover as claimed in claim 1, wherein:

said planar upper surface of said frame member has a plurality of peripheral edges;

said frame member additionally comprises a side wall extending downwardly from said peripheral edges of said planar upper surface; and said side wall and said edge wall of said frame member being integrally formed at a location of said one or more lugs.

14. A road surface installation frame and cover as claimed in claim 13, wherein said planar upper surface of said frame member has four peripheral edges and is rectangular in shape, and said cover member is circular, such that the side wall and the edge wall of the frame member are integrally formed at midpoints of the four peripheral edges of the upper surface.

* * * * *